US005865694A

United States Patent [19]

Duong-Van

[11] Patent Number: 5,865,694

[45] Date of Patent: Feb. 2, 1999

[54] TENNIS RACKET WITH VIBRATION DAMPING AND TORSIONAL ELASTICITY

[76] Inventor: Minh Duong-Van, 810-18 Coleman Ave., Menlo Park, Calif. 94025

[21] Appl. No.: 48,469

[22] Filed: Mar. 26, 1998

Related U.S. Application Data

[60] Provisional application No. 60/062,937, Oct. 22, 1997.

[51] Int. Cl.[6] ..... A63B 49/02

[52] U.S. Cl. ..... 473/520; 473/549; 473/521

[58] Field of Search ..... 473/520, 521, 473/531, 549, 173, 183

[56] References Cited

U.S. PATENT DOCUMENTS

| | | | |
|---|---|---|---|
| 1,563,780 | 12/1925 | Ovenshire | 473/521 |
| 4,007,929 | 2/1977 | Figa . | |
| 4,033,583 | 7/1977 | Ehrhart . | |
| 4,052,060 | 10/1977 | Balkcom | 473/531 |
| 4,367,871 | 1/1983 | Schiefer . | |
| 4,746,119 | 5/1988 | Jeanrot . | |
| 4,906,002 | 3/1990 | Goffney et al. | 473/531 |
| 5,071,125 | 12/1991 | Shen | 473/521 |
| 5,108,114 | 4/1992 | Marx | 473/531 |
| 5,143,373 | 9/1992 | Meissner . | |
| 5,178,387 | 1/1993 | Kuebler . | |
| 5,236,198 | 8/1993 | Haines et al. . | |

*Primary Examiner*—Raleigh W. Chiu
*Attorney, Agent, or Firm*—Steven M. Mitchell

[57] ABSTRACT

A tennis racket with handle and head coupled with an interconnection insert provides torsional elasticity and vibration damping. The racket handle has a mating extension extending toward the head and the head includes a mating extension extending toward the handle such that the handle and head mate together at the mating extensions. The handle extension has a tongue with two bores and a pair of elastic bushings extending through bores. The head mating extension comprises a recess or U-shaped channel which receives the tongue and includes a pair of securing pins extending through the bushings and being rigidly secured to the sides of the recess or channel. The bushings and pins are positioned transverse to the longitudinal extent of the handle and parallel to the racket face. The bushings perform a shock absorbing function, provide torsional elasticity and control the racket stiffness. A stabilizing bushing may be added parallel to the first two bushings and it extends through the tongue and through the sides of the recess or channel. A stabilizing pin then extends through this bushing.

12 Claims, 5 Drawing Sheets

TENNIS RACKET WITH VIBRATION DAMPING AND TORSIONAL ELASTICITY

This application claims the benefit of provisional application Ser. No. 60/062,937 filed Oct. 22, 1997.

BACKGROUND OF THE INVENTION

1. Field of the Invention

The present invention relates generally to tennis rackets and more particularly to an improved handle construction.

2. Prior Art

Tennis rackets are constructed of various materials with newer models constructed of graphite, titanium, carbon fiber, Kevlar or other high strength, light-weight materials. The head, neck and handle are typically constructed as a single molded structure. The racket has a stiffness which is substantially predetermined and is a function of the material, racket length and structure.

A goal of racket designers is to provide a "sweet spot" which is as large as possible. The size of the sweet spot is a function of numerous variables including racket stiffness, string tension and others. The larger the sweet spot the more room for error there exists for the player hitting the ball. Providing a racket with a larger sweet spot will improve almost every player's game.

Balls striking the racket face off the longitudinal axis of the racket handle tend to torque or twist the racket in the player's hand causing the struck ball to rebound at an undesirable angle to the direction of motion of the racket and reducing the player's control of the shot. It has been discovered that a racket which provides a torsional elasticity can reduce this deflection angle and improve shots struck off axis.

Injuries to the wrist, elbow or shoulder are sometimes sustained by tennis players from the repeated shocks imparted by striking the ball. Additional injury may result to the wrist from the twisting torque caused by a player striking the ball off the center of the racket face as discussed above. Various designs have been developed to damp the transmission of vibration and shock from the racket to the player. For example, in U.S. Pat. No. 5,236,198 to Haines et al, titled "Games Racket Frame", a discontinuous racket frame is described. The frame has two parts which are joined by a vibration-damping material secured in position by plugs. A reinforcing collar surrounds the discontinuity and together with a rod contained within the vibration-damping material stabilizes the racket handle. This design is intended to reduce the transmission of shock and vibration to the player, thus minimizing the risk of tennis elbow and similar injuries.

Another racket design intended to reduce impact shock is U.S. Pat. No. 5,178,387 to Kuebler titled "Racket for Ball Games, in Particular a Tennis Racket". In this design, a pair of parallel groove-like channels are positioned on opposing sides of the throat and parallel to the racket face to create a hinge. The channels are filled by an elastic shaped mass. However, neither this design nor that of the 5,236,198 patent has found widespread commercial success.

A tennis racket of improved design which reduces or damps some of the shock transmitted to the player would be quite beneficial. Further, a racket which is more flexible or "soft" would provide improved training for an injury-prone player or one recuperating from tennis elbow or other injuries.

The power of the serve with a conventional racket comes from the string tension and the angular velocity of the racket head at the moment the ball is struck. Any design which enhances the energy transferred to the ball by the racket head, even by a small amount, can provide noticeable improvement in a player's serve.

Another important feature of a tennis racket to many tennis players is the feel of the racket when it strikes the ball. This is particularly important for net play when the racket is not so much swung as used to reflect the ball. It has been discovered that the medium frequency components of vibration are the critical part of the feel and should be preserved while the lower and higher frequency components of vibration can be damped.

In most rackets, the weight and balance (feel) are mainly controlled by the handle. For example, the Wilson Classic manufactured by Wilson Racket Sports weighs 345 grams and is a heavy racket designed for strong players. The Wilson 6.2 which weighs 298 grams is a light racket designed for weaker players. In both rackets, the weight of the head, without the handle, is approximately the same. Thus a new design with separate head and handle can continuously vary the total weight and balance (feel) of the racket by adjusting the handle weight.

Recent technology improvements have provided extra long tennis rackets which have been utilized by some top players to improve their games, particularly by increasing the speed of their serves. A racket design which is compatible with different racket lengths is desirable.

It is therefore an object of the invention to provide an improved tennis racket having torsional elasticity and an enlarged sweet spot.

It is a further object of the invention to provide a tennis racket design having vibration damping.

It is another object of the invention to provide a tennis racket with a continuous spectrum of weight and balance.

It is yet another object of the invention to provide an improved tennis racket design having a variable length.

SUMMARY OF THE INVENTION

The present invention is directed to a tennis racket having a head portion including a head frame and throat with the head frame having a striking surface such as stringing in the frame for striking a tennis ball. The racket has a handle including a mating extension or interconnection portion extending toward the head portion. The head portion includes a head mating extension or interconnection portion extending toward the handle from the throat such that the handle and head mating extensions can be mated together. A mating section or interconnection region comprising the two mating extensions includes first and second elastic bushings or tubing positioned in first and second bores extending through one of the mating extensions transverse to the longitudinal extent of the handle and parallel to the stringing. First and second securing pins extend through the bushings and are rigidly coupled to the other mating extension. The mating extensions for both the handle and head may be separate inserts which are glued or otherwise secured into the frame tubes. Alternatively the mating extensions may be integrally molded as part of the frame during manufacture. The bushings may be separate elastic tubes or an elastomer injected into the bores. The pins may be separate pieces or part of a molded, cast or machined structure.

The bushings perform a twist energy converting function and a shock absorbing or damping function and their elasticity affects the stiffness of the racket. Thus, when a ball is struck by the racket, the racket flexes in both the direction of motion of the racket face and rotationally about the longitudinal extent of the racket due to the elasticity of the bushings. This torsional elasticity reduces the torque transmitted to the player's arm and causes balls hit off the longitudinal axis of the racket face to rebound at a reduced angle to the direction of motion of the racket face. It also stores twisting energy and imparts it back onto the ball. Further, flex energy with the torque vector perpendicular to the plane of the strings is imparted back to the ball. The combined affect of the racket flex and the torsional elasticity provide a substantially improved sweet spot. The stiffness of the racket can also be controlled by varying the spacing between the bushings. The larger the spacing, the more stiff the racket. Various durometer bushings of, for example, thermoplastic rubber material may be used to allow selection of racket damping and torsional elasticity.

In a currently preferred embodiment of the invention, the handle mating extension is an insert and includes the first and second bushings in a tongue extending from a base which is glued or riveted to the racket handle. A racket head insert casing is a U-shaped channel with holes for receiving the pins in the sides of the channel. The head insert casing is glued or riveted into the racket head tube. The pins are secured in the holes on the sides of the channels and pass through the elastic bushings. A third bore, below and parallel to the first two bores, may be added to the handle insert tongue. A third bushing extends through this bore and also extends through both sides of the head insert casing. A third stabilizing pin extends through the third bushing but is not rigidly secured. This bushing/pin combination limits the flexing of the head and handle relative to each other allowed by the first and second bushing/pin combinations. Alternatively, by providing a close fit between the tongue of the handle insert and the channel of the head insert casing the third bushing/pin combination may be omitted.

The positioning of the mating section is preferably selected to allow sufficient room on the racket handle for a two-handed grip which does not overlap the mating section. It may be desirable for some designs to locate the mating section further down in the handle itself. However, the separation of the racket head and handle at the interconnection region defines this region as a vibration node, thus substantially reducing the propagation of shock energy to the player's hand.

In another embodiment of the invention, the weight and length of the handle are selected to provide the overall racket length, balance and weight desired.

The present invention can also be used with other game rackets such as racquetball and squash rackets.

BRIEF DESCRIPTION OF THE DRAWINGS

The various features and advantages of the present invention may be more readily understood with reference to the following detailed description taken in conjunction with the accompanying drawings in which.

DETAILED DESCRIPTION OF THE INVENTION

Figure 1:
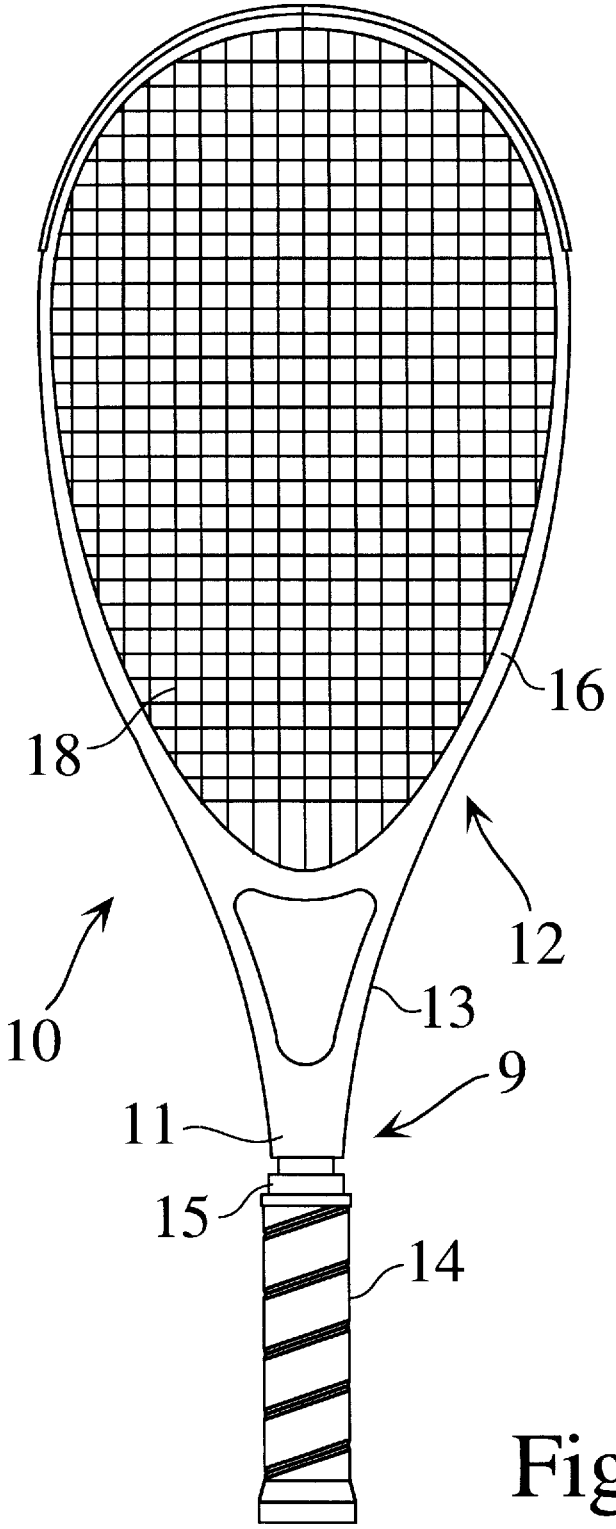
FIG. 1 is a front elevation view of a tennis racket of the invention.

Referring now to FIG. 1, a tennis racket 10 according to the invention is shown. Racket 10 has a head portion 12 and a handle 14. The head portion 12 and handle 14 are connected at a mating section 9 with head tubing 11 and handle tubing 15. The head portion 12 has a frame 16 which supports stringing 18 and extends to a throat 13.

Figure 2:
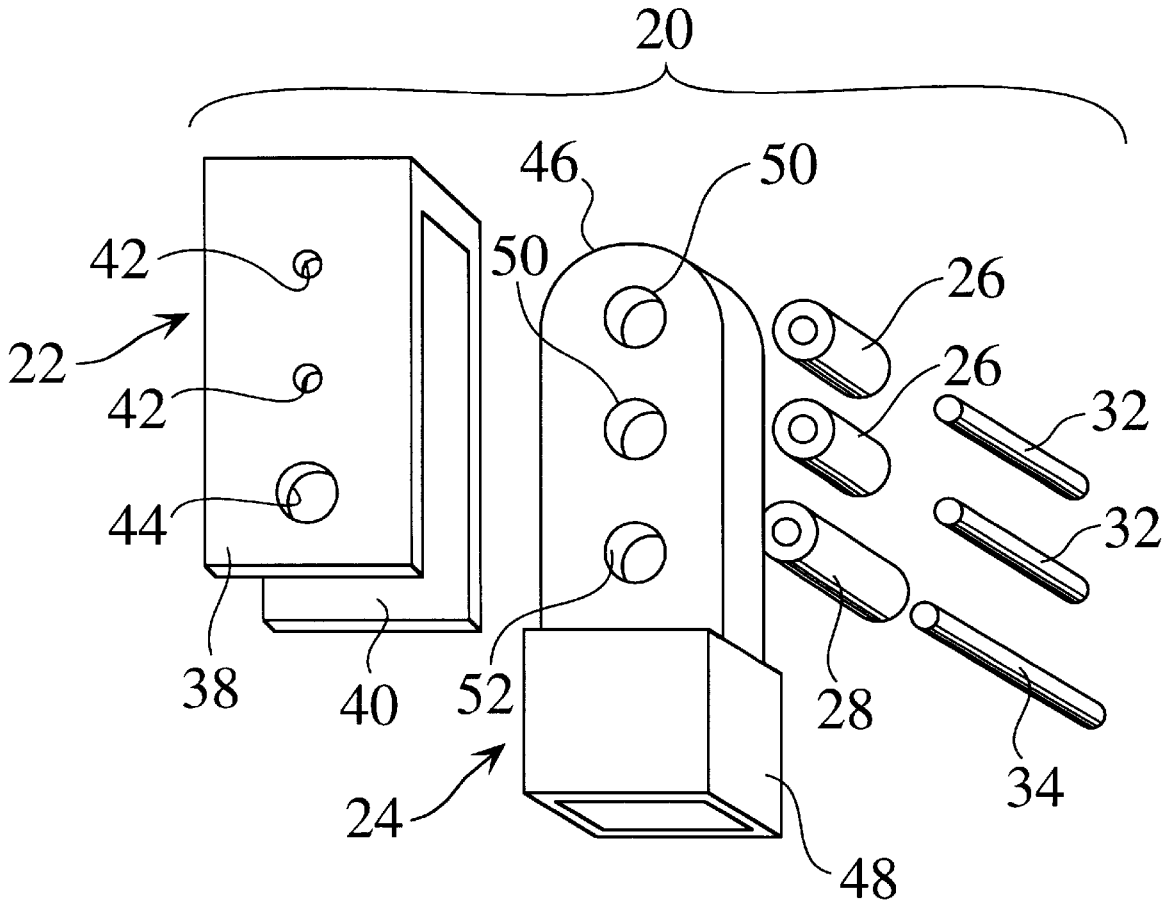
FIG. 2 is an exploded view of a racket insert according to the invention.

Referring now to FIGS. 2, an exploded view is shown of a damping insert 20 which, along with head tubing 11 and handle tubing 15, makes up mating section 9. The damping insert 20 includes a racket head insert casing 22, a racket handle insert 24, two shorter hollow elastic bushings 26, one longer elastic bushing 28, two securing pins 32 and a stabilizing pin 34. The head insert casing 22 is a U-shaped channel with two sides 38, 40. Each side of the casing 22 has two smaller holes 42 and one larger hole 44. Handle insert 24 further includes a tongue 46 extending from a base 48. The tongue 46 has two bores 50 sized to accept the two shorter bushings 26 and a third bore 52 sized to fit the longer bushing 28. The inner diameter of bushings 26 provide a tight fit for pins 32 as does the inner diameter of bushing 28 for stabilizing pin 34.

The head insert casing 22 and handle insert 24 may be made of various materials such as aluminum, magnesium or carbon reinforced epoxy. The most important factors in choosing the material for the inserts is strength and weight. The inserts must be strong enough to withstand extended play and the occasional slamming of the racket on the court but it is desirable to minimize any added weight to the racket.

Figure 3:
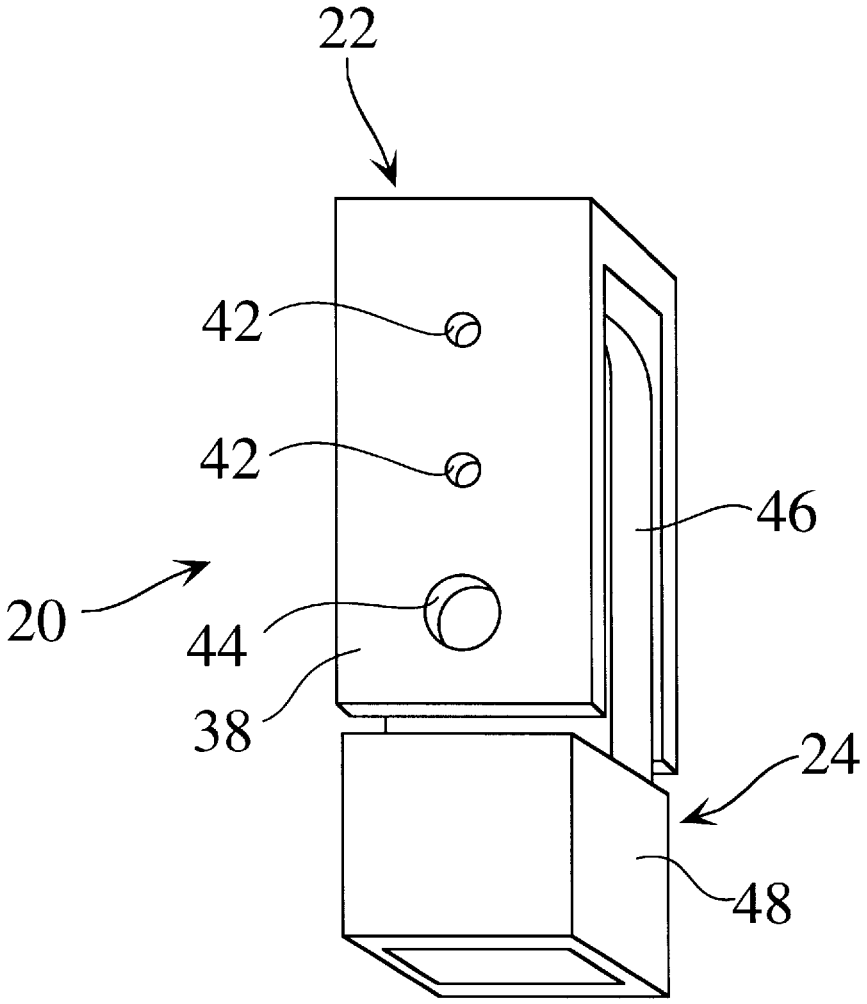
FIG. 3 is a perspective view of an assembled insert.

FIG. 3 shows an assembly perspective view of insert 20 without the bushings and pins inserted. It can be seen that head insert casing 22 fits over tongue 46 of handle insert 24. This is a loose fit as it is not intended that the outer faces of tongue 46 be in contact with the inner walls of head insert casing 22.

Figure 4:
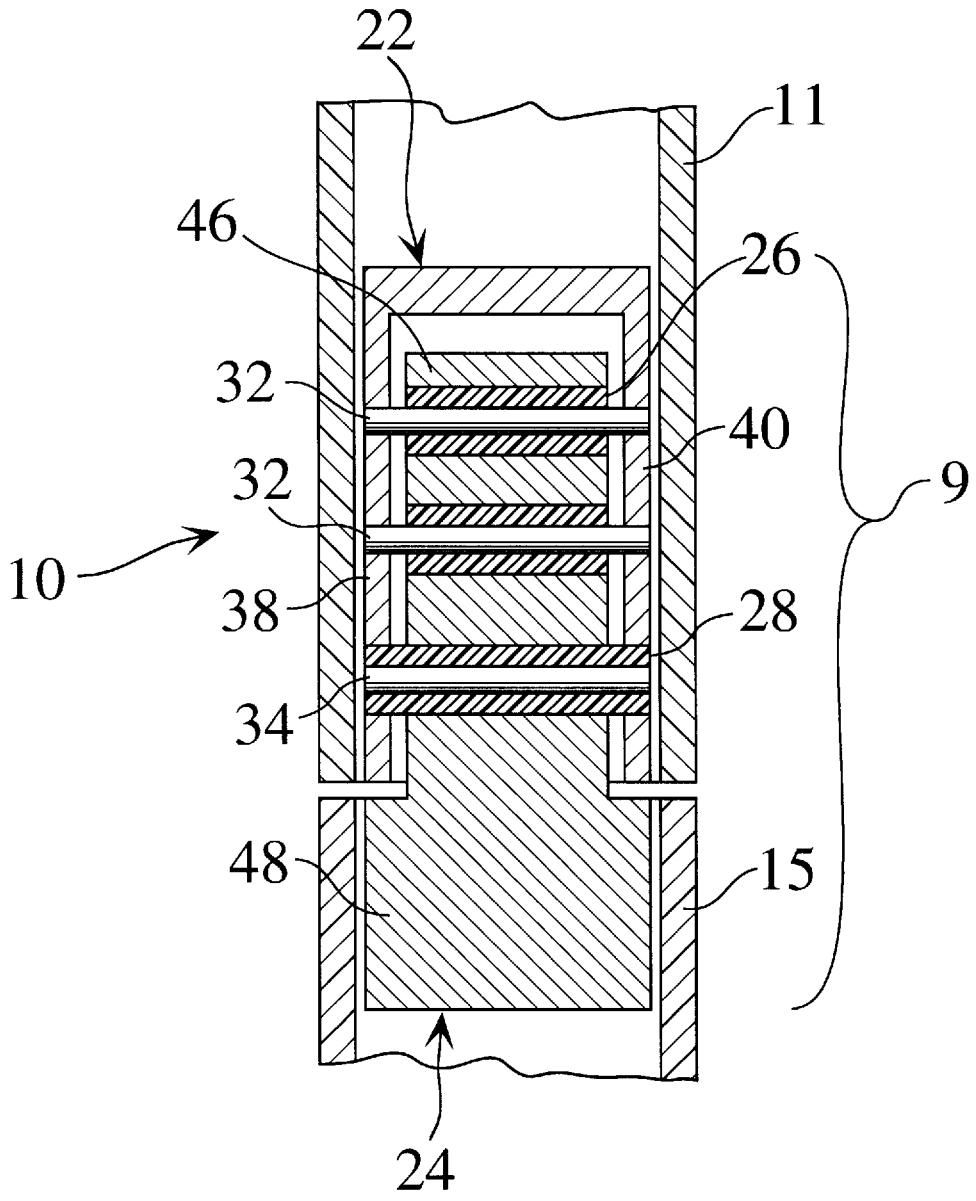
FIG. 4 shows a side sectional view of a racket handle mating section with the insert assembled in tubing of the racket head and handle.

Referring now to FIG. 4, a portion of the racket 10 including mating section 9 with insert 20 is shown in cross-section. An assembled insert is placed into the racket head and handle with the racket head insert casing 22 sliding into head tubing 11 and the racket handle insert 24 sliding into the handle tubing 15. The sides 38, 40 of head insert casing 22 are glued to the inside of the head tubing 11 and at least two sides of the racket handle insert base 48 are glued or epoxied into the racket handle tube 15. Thus, the insert can be coupled to the tubes of the head and handle either during manufacturing with epoxy or later with hot glue such as is known to connect the blade of a hockey stick to the handle.

In an alternative embodiment of the invention, the stabilizing bushing 28 and stabilizing pin 34 may be eliminated if there is a precise close fit of tongue 46 into the channel of head insert casing 22. In this case, the comers of tongue 46 are chamfered to allow limited rotation or twisting of tongue 46 in the head insert casing 22.

Figure 5:
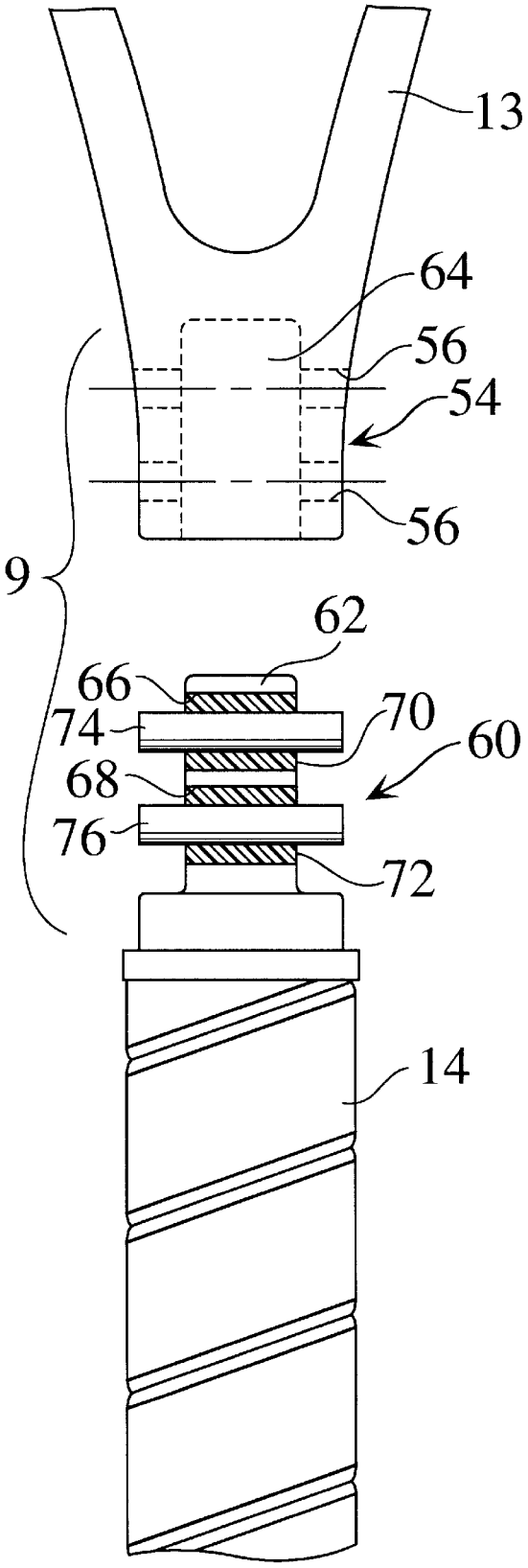
FIG. 5 is an exploded front elevation view of a racket according to another embodiment of the invention.
Figure 6:
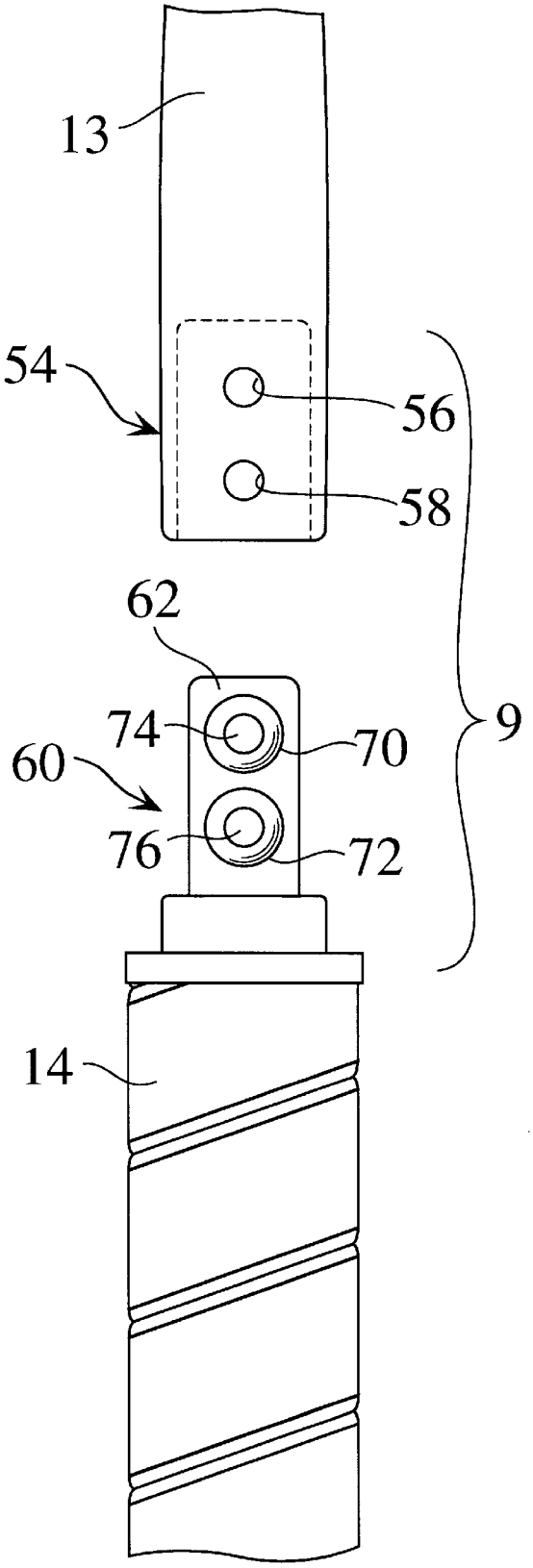
FIG. 6 is an exploded side elevation view of the racket of FIG. 5.

Referring now to FIGS. 5 and 6, an alternative embodiment of the invention will be discussed. These figures show a front exploded and side exploded view, partially in section, of a racket wherein the mating section 9 is formed from integral parts of the racket frame. The head portion of the racket includes a mating extension 54 extending from the throat 13 made by truncating the racket frame below the throat and forming first and second bores 56 and 58 (shown in phantom lines in FIG. 5) of about 0.25 inches diameter extend through each side of head mating extension 54 parallel to each other and in the plane of stringing 18.

Handle 14 has a mating extension 60 including a tongue 62 which mates into a recess 64 formed in mating extension 54 of the head portion. Tongue 62 and recess 64 are sized to allow both flexing and twisting motion of tongue 62 in recess 64. The spacing between the tongue 62 and the sides of the recess 64 must be sufficient to allow such twisting and may be for example between about 0.5 and 1.0 mm. In addition, this gap may be filled or injected with rubber to increase the stiffness of the insert. This applies to the first embodiment as well.

Tongue 62 includes first and second bores 66 and 68 which correspond to bores 56 and 58 respectively. As shown in FIGS. 5 and 6, bores 66 and 68 have a larger diameter than the bores 56 and 58 of the head mating extension and accept hollow elastic bushings 70 and 72. The inner diameters of bushings 70 and 72 correspond to the diameters of bores 56 and 58 of the head mating extension 54. Cylindrical securing pins 74 and 76 extend through bores 56 and 58 and bushings 70 and 72, respectively, to secure the head portion 12 to the handle 14.

The diameters of the pins are selected to provide an interference fit with bores 56 and 58 and bushings 70 and 72. The material of the securing pins 74, 76 can be any strong hard material such as aluminum or other metal, carbon fiber, graphite or a hard plastic.

The positioning of the mating section where the mating extensions are joined is preferably selected to coincide with the natural vibration node of the racket which may be about one to five inches above the racket handle. However, other locations may be desirable, particularly to allow room on the handle for a two-handed grip.. In fact, the separation of the racket into the handle and head portion defines a node at the mating section.

Various durometer bushings of, for example, thermoplastic rubber material may be provided to allow selection of racket stiffness. For example, a medium durometer vacuum tubing has been used having in inner diameter of 3/16 inch and an outer diameter of 3/8 inch. An alternative to tubing is to inject a rubber such as Aquaseal available from McNett Corporation of Bellingham, Wash. in the bores around the pins. In addition, desirable racket properties may be achievable by pairing bushings of different durometer or by providing pins, bushings and bores of different diameters or spacing.

In an alternative embodiment of the invention (not shown), the female portion of the mating section may extend from the handle and the male portion of the mating section may extend from the head portion. Other interconnection configurations are also possible without deviating from the scope of the invention.

A further feature of the invention is provided by selecting different thickness for the two elastic bushings. The smaller bushing will compress first when the racket strikes the ball and present more of a pivot point. With a smaller bushing closer to the handle and a larger bushing closer to the head a "head heavy" design in achieved. With a larger bushing closer to the handle and a smaller bushing closer to the head a "head light" design in achieved.

In use, rackets according to the invention provide improved effective racket head speed at the time of contact with the tennis ball. The elastic bushings are compressed by the impact of the ball with the racket head and rebound while the ball is still in contact with the racket face to impart greater force to the ball. Thus, energy stored in the bushings is transferred back into the ball. In this case, the way a ball rebounds from the racket becomes more a function of the elastic bushings and less a function of the string selection and tension. In effect, collision of the ball with the racket becomes more elastic with more energy in the form of momentum or velocity transferring back to the ball and less energy being absorbed by the arm of the player. For less demanding games, such as with practice rounds, a racket with softer bushing can be utilized to provide a high degree of flexibility. This is also beneficial for the injury-prone or recuperating player. In addition, torsional elasticity is provided when the ball is struck away from the longitudinal axis of the racket face. This enlarges the racket sweet spot and reduces twisting torque transferred to the player's arm.

Since the motion of the racket face during a stroke is from down to up in most ground strokes, one expects that top spin is automatically imparted onto the ball. However, since the typical "dwell-time", i.e. the time during which the ball is in contact with the racket, is tenths of milliseconds, the slight vertical component of the racket motion is not effectively transferred. This requires an excessive vertical sweep of a conventional racket to impart top spin. Rackets according the invention incorporate a flex of the handle so that the dwell-time can be increased by up to a factor of three. Thus, for a regular "flat" stroke having a natural down to up motion, the increased dwell-time automatically imparts more top spin. This can eliminate the need for an excessive top spin stroke. Additionally, the increase of dwell-time will make the aim of the ball more precise since the long contact time enhances the effect of the racket swing trajectory thus making the aim better.

In conventional racket designs, the tennis racket string face has strings of various lengths, shorter near the periphery, longer at the center. Thus, the string deflection varies from racket side to racket center. This reduces the sweet spot to a small area near the center of the string face. In rackets made according to the teaching of the invention, the lateral flex of the racket about the bushing centroid stores and reimparts the energy back to the ball with the proper time scale. This increases the sweet spot in the longitudinal direction along the axis of the handle. Furthermore, the torsional flex will store and reimpart the energy back to the ball with approximately the same time scale. This increases the sweet spot in the direction from one lateral rim of the racket to the other rim (perpendicular to the axis of the handle.) The combination of these two effects dramatically increases the size of the sweet spot.

With conventional rackets, a high frequency "ping" noise is heard when the ball is struck. Many players put a damper on the strings to reduce the high frequency vibration. While this may be desirable to some extent, it is also desirable to maintain a sufficient amount of the medium frequency component to allow net volleys to be properly felt by the player. The medium frequency vibrational components that are retained give the player the feel of the hit after a stroke, especially for at net games. Conventional damping rackets eliminate substantially all frequencies, thus eliminating the racket feel. The medium frequency vibration components are retained in the racket of the invention by providing the stabilizing bushing and pin or by securing the gap formed at the mating section with a high-strength, elastic adhesive such as is used with wetsuits. Alternatively, a gasket in the gap at the mating section can be used to stabilize the head and handle relative to each other.

It should be understood that various alternatives to the embodiments of the invention described herein may be employed in practicing the invention. For example, the invention has been described with respect to tennis rackets but is also applicable to other rackets such as racquetball rackets and squash rackets. It is thus intended that the claims define the scope of the invention and that structures and methods within the scope of these claims and their equivalents be covered thereby.

What is claimed is:

1. A racket comprising:

a head including a frame for supporting a ball striking surface in said frame;

an elongate handle having a longitudinal extent;

said handle including an interconnection portion extending toward said head portion;

said head including an interconnection portion extending toward said handle such that said handle and head interconnection portions mate together;

said handle interconnection portion including an extension having first and second bores extending through said extension transverse to the longitudinal extent of said handle and parallel to said ball striking surface when said interconnection portions are mated together;

first and second elastic bushings positioned in said first and second bores, respectively; and said head interconnection portion including first and second securing pins extending through said first and second bushings in said handle interconnection portion.

2. The racket of claim 1 and further including a third bore in said handle interconnection portion spaced from and parallel to said first and second bores, and including a third elastic bushing in said third bore and extending into said head interconnection portion, and a third securing pin extending through said third bushing.

3. The racket of claim 1 wherein said handle interconnection portion and said head interconnection portion each comprises a separate insert rigidly attached to said handle and said head, respectively.

4. A tennis racket comprising:

a head including a striking surface and a head mating extension;

a handle having a longitudinal extent and including a handle mating extension;

said head being connected to said handle, with said handle and head mating extensions including first and second mating holes extending through each of said head and handle mating extensions, said holes extending parallel to each other and to said striking surface and transverse to said longitudinal extent of said handle;

first and second hollow elastic members positioned in said first and second holes respectively, in at least one of said mating extensions, and first and second securing pins extending through said first and second elastic members to connect said head to said handle.

5. The tennis racket of claim 4 and further including an elastic collar surrounding and secured to each of said mating extensions.

6. The tennis racket of claim 4 and further including a gasket positioned between said handle and said head and surrounding at least a portion of said mating extensions.

7. The tennis racket of claim 4 wherein said elastic member comprises an elastic bushing.

8. The tennis racket of claim 4 wherein said elastic member comprises an elastomer injected into said holes.

9. A racket insert for insertion between a handle and a head of a racket to improve the performance of said racket, said insert comprising:

a handle mating extension for coupling to the handle such that it will extend toward said head upon assembly;

a head mating extension for coupling to said head such that it will extend toward said handle upon assembly; and first and second securing pins extending through said handle and head mating extensions coupling said head and handle together such that upon assembly of said insert into said racket and said mating extensions to each other, each of said pins extends transverse to a longitudinal extent of said handle and parallel to a plane of said head.

10. The insert of claim 9 and further including first and second hollow elastic bushings surrounding at least a portion of said first and second pins, respectively, and extending through said holes in at least one of said mating extensions.

11. A racket comprising:

a head including a head mating extension;

a handle having a longitudinal extent and including a handle mating extension;

said head being connected to said handle, with said handle and head mating extensions being joined at a mating section;

first and second elastic bushings positioned in one of said handle and head mating extensions and extending parallel to each others and transverse to said longitudinal extent of said handle; and first and second securing pins extending through said first and second bushings, respectively, and being rigidly fixed to the other of said head and handle mating extensions to connect said head to said handle.

12. The racket of claim 11 and further including:

a third bore extending through both of said head and handle mating extensions;

a stabilizing elastic bushing positioned in said third bore; and a stabilizing pin extending through said stabilizing bushing.

* * * * *